United States Patent [19]

Weir

[11] Patent Number: 4,490,726

[45] Date of Patent: Dec. 25, 1984

[54] COLLAPSIBLE ROOFTOP MICROWAVE ANTENNA WITH WIND LOADING FEATURE

[75] Inventor: Walter F. Weir, Ontario, Canada

[73] Assignee: Andrew Corporation, Orland Park, Ill.

[21] Appl. No.: 384,527

[22] Filed: Jun. 3, 1982

[51] Int. Cl.[3] ..... H01Q 1/12

[52] U.S. Cl. ..... 343/840; 343/DIG. 1

[58] Field of Search ..... 343/DIG. 1, 840, 880, 343/882, 912, 915

[56] References Cited

U.S. PATENT DOCUMENTS

| | | | |
|---|---|---|---|
| 2,126,030 | 8/1938 | Peterson | 343/812 |
| 2,329,200 | 9/1943 | Hefele | 343/882 |
| 2,683,011 | 7/1954 | Haggerty | 343/880 |
| 3,090,960 | 5/1963 | Ingledew | 343/906 |
| 3,229,295 | 1/1966 | Watkin et al. | 343/709 |
| 3,286,266 | 11/1966 | Barnes | 343/761 |
| 3,304,037 | 2/1967 | Candela | 343/882 |
| 3,510,877 | 5/1970 | Turriere | 343/765 |
| 3,521,285 | 7/1970 | Mautner | 343/709 |
| 4,146,897 | 3/1979 | Wilson et al. | 343/DIG. 1 |

FOREIGN PATENT DOCUMENTS

| | | | |
|---|---|---|---|
| 2227563 | 1/1974 | Fed. Rep. of Germany | 343/840 |
| 573762 | 12/1945 | United Kingdom | 343/880 |

*Primary Examiner*—Eli Lieberman

*Attorney, Agent, or Firm*—Leydig, Voit, Osann, Mayer & Holt, Ltd.

[57] ABSTRACT

A parabolic, collapsible rooftop microwave antenna for direct satellite-to-consumer TV transmission pivots in the direction of the aperture axis about a horizontal pivot axis in response to excessive wind forces. The antenna has a cross-head theodolite-type mount adjustable for azimuth and elevation, with a horizontal pivot that provides axial displacement if the axial wind force exceeds a predetermined threshold force. This limits the torque transmitted to the roof on which the antenna is mounted to a reasonably low level. Various torque sensitive horizontal pivots are described including a torqued pivot bolt, torqued slide bolts disposed in arcuate slots for limit-stop action, shear pins for quick release action, and biased springs for collapse and self-restoration to the initial vertical position in response to transient wind force exceeding a threshold force set by the spring bias.

9 Claims, 8 Drawing Figures

COLLAPSIBLE ROOFTOP MICROWAVE ANTENNA WITH WIND LOADING FEATURE

Today rapid advances in electronic circuits have made direct satellite to consumer TV transmission economically feasible. But because transmitter power at the satellite is limited, a rather large parabolic microwave antenna, for example having approximately a one-meter diameter, is required to concentrate the weak signal received from the satellite. The rather large size of the antenna requires a rigid supporting structure to keep the antenna aimed at the satellite. Without the present invention, considerable dilligence has to be exercised in firmly attaching the supporting structure to the roof of the consumer's dwelling so that the antenna will not be ripped off the roof during transient conditions of high winds.

In appreciation of these above-mentioned considerations, the applicant has discovered that the expense of making, and the difficulty and expense of installing, a suitable structure for mounting a rooftop microwave antenna may be reduced by using a microwave antenna that has a mounting configuration responsive to high wind conditions.

Thus, the general aim of the invention is to provide a rooftop microwave antenna having a mounting configuration that changes in response to high winds of a predetermined velocity. Specifically, it is an object of the invention to provide a parabolic reflector-type antenna with a horizontal pivot permitting controlled movement of the antenna in its forward and rearward axial directions in order to permit the antenna to move from a first predetermined generally vertical geometric configuration aimed at the satellite to a second bent over or collapsed configuration, approaching horizontal in the limit, to reduce axial wind loading when high winds of a predetermined velocity are encountered. A related objective is to provide such by a structure that is inexpensive, reliable, and easy to mount and adjust for aiming the parabolic reflector at the satellite.

Moreover, it is an objective to provide a rooftop microwave antenna that may be directly mounted on conventional roofs without modification or internal bracing of the roofs.

It is also an object of the invention to assure that the change in the configuration or orientation from the first geometric configuration of the antenna does not damage the antenna.

Another object of the invention is to provide automatic as well as manual means for restoring the antenna to its normal operating, generally vertical geometric configuration when the wind velocity falls below the predetermined velocity.

Still another object of the invention is to provide manual means for adjusting the threshold wind velocity at which the antenna changes its geometric configuration.

Another object of the invention is to provide the antenna with a mechanism so that the capacity of the antenna to react the wind force drops suddenly when a predetermined wind force is exceeded so that the antenna is quickly released from its normal operating position in response to a gust of high wind.

Other objects and advantages of the invention will become apparent upon reading the following detailed description and upon reference to the drawings in which.

Figure 1:
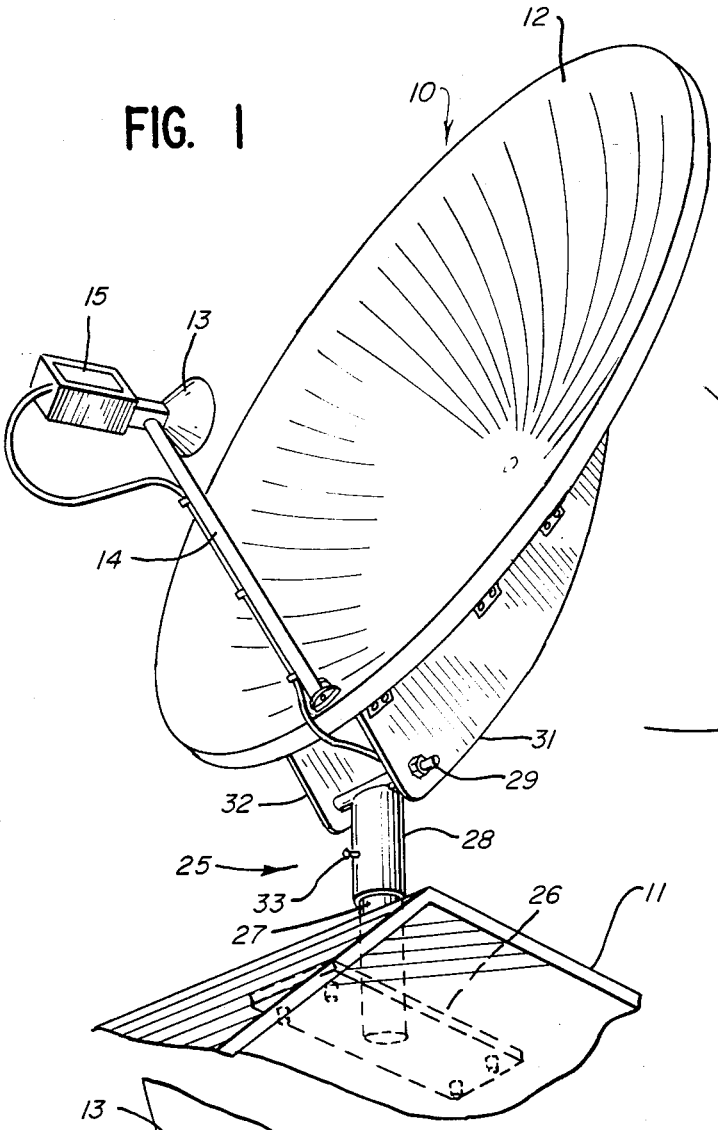
FIG. 1 is a perspective view of an antenna, according to one embodiment of the invention, mounted on the roof of a house.

While the invention is susceptible to various modifications and alternative forms, specific embodiments thereof have been shown by way of example in the drawings and will herein be described in detail. It should be understood, however, that they are not intended to limit the invention to the particular forms disclosed, but, on the contrary, the intention is to cover all modifications, equivalents, and alternatives falling within the spirit and scope of the invention as defined by the appended claims.

Turning now to the drawings, FIG. 1 shows in perspective a parabolic reflector-type microwave antenna generally designated 10 mounted on a conventional roof 11 of a house. The parabolic reflector 12 is approximately one meter in diameter in order to sufficiently concentrate the microwave transmissions from a satellite in geosynchronous orbit (not shown) and to focus the microwave energy (represented by phantom lines parallel to the aperture axis 24 in FIG. 2A) at a feed horn 13. The invention is not limited to antennas of any particular size, and the one-meter reflector is merely a typical example. The feed horn 13 is fixed at the focal point (of the parabolic reflector) on a support beam 14 attached to the parabolic reflector 12. The feed horn 13 serves to guide the microwave energy into the "front end" 15 of the microwave receiver which converts the electromagnetic microwave radiation to electrical currents. These currents are amplified and fed via a coaxial lead-in cable 16 to the inside of the consumer's house to the rest of the satellite receiver electronics and the consumer's television set (not shown).

Figure 2A:
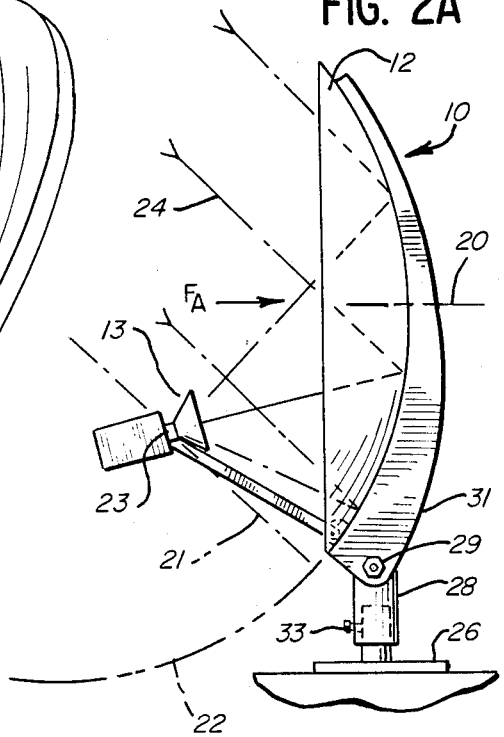
FIG. 2A and FIG. 2B are side and rear elevation views, respectively, of the antenna embodiment shown in FIG. 1.

The geometric orientation of the feed horn 13 and parabolic reflector 12 is more clearly shown in the side view of FIG. 2A. This type of reflector and feedhorn orientation is known as an "offset paraboloid" reflector antenna. It should be noted that the shape of the reflector 12 is parabolic with the feed horn 13 located on the imaginary axis 21 of the imaginary paraboloid 22 at the focal point 23, but with the aperture axis 24 noncoincident but parallel with the imaginary axis 21 of the imaginary parabolic surface 22. An offset paraboloid reflector is preferred since then the feed horn 13 and the support beam 14 do not block the incoming radiation (phantom lines parallel to the aperture axis 24 in FIG. 2) from the satellite (not shown). Also, it is desirable to have the reflector 12 generally in a vertical position so that it does not collect rain, ice, or snow, and the offset paraboloid reflector construction permits this to be done even though the incoming radiation from the satellite is received at an angle of approximately 10° to 40° of elevation from the horizon, depending on the longitude and latitude of the antenna location.

Figure 2B:
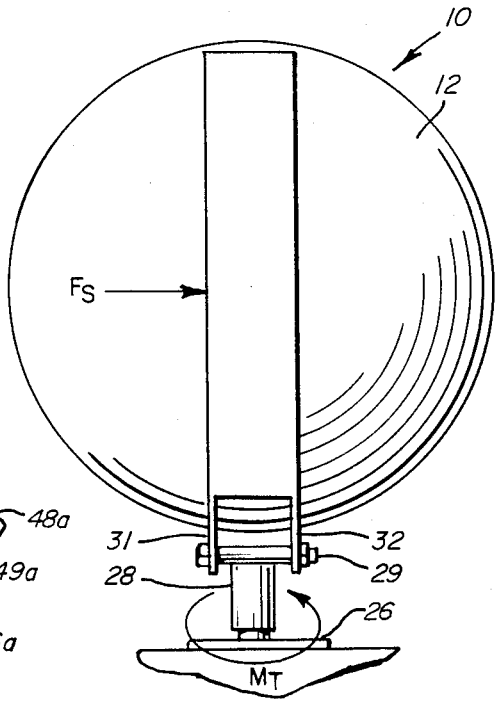

One problem associated with a vertically mounted parabolic reflector microwave antenna is that considerable force is exerted on the antenna by winds blowing in the direction of the surface centerline axis 20 (FIG. 2A). As shown in FIG. 2A and FIG. 2B, wind impinging on the antenna generates forces in the axial and side directions, and also generates a twisting torque. The force along the surface centerline axis 20 is designated by the variable $F_A$ while the side force in the horizontal direction and also perpendicular to the surface centerline axis 20 is designated by the variable $F_S$. The twisting torque generated around the vertical axis of the antenna is designated by the variable $M_T$. It is known, for the antenna of FIG. 2A and 2B, that the axial wind force $F_A$ is about four times the side force $F_S$ due to the fact that wind blowing against the antenna in the axial direction is "scooped up" by the parabolic reflector 12 while wind in the side direction rather easily curves around the parabolic reflector. The twisting torque $M_T$ is determined by the pressure variation across the reflector which is dependent on aerodynamic characteristics versus wind angle. The antenna and antenna mount must have sufficient mechanical strength to withstand these forces associated with some rated or presumed maximum wind velocity. Standard parabolic microwave antennas, for terrestrial communication as seen on microwave towers, are designed to survive rather high winds of at least 125 mph in order to reduce maintenance and prevent interruption of service.

The applicant has discovered that for rooftop mounting of microwave antennas in consumer applications, winds at velocities as low as 45 mph may generate unacceptable levels of force. A 45 mph axial wind, for example, generates about 65 lbs. of axial force $F_A$ which is about the maximum limit for direct attachment of the antenna to the conventional roof of a house without requiring extensive bracing or modification of the roof. But gusts of wind above 45 mph occur with statistical frequency, and if unchecked, these gusts of high wind can cause excessive damage to the roof.

In accordance with an important aspect of the invention, the antenna 10 is provided with an antenna mount generally designated 25 which is economical yet adjustable and stable. The antenna mount 25 has a rather small roof attachment or mounting pad 26 which may be screwed directly to a rafter and the roof boards without bracing or modification of the roof. The roof attachment pad 26 has a vertical post 27 which supports a cross-head 28. The cross-head 28 receives a generally horizontal pivot bolt 29 securing the cross-head 28 between two mounting ribs 31, 32 which are fastened to the back of the parabolic reflector 12. Thus the combination of the roof attachment pad 26, cross-head 28, and mounting ribs 31, 32 comprise a simple and economical yet stable theodolite-type mount adjustable for azimuth and elevation. The azimuth adjustment is provided by rotating the antenna 10 about the vertical post 27 and fixing the angular position by advancing an azimuth locking screw 33 threaded into the cross-head 28 to interfere with the post 27. The elevation is adjusted by pivoting the reflector 12 and mounting ribs 31, 32 about the horizontal pivot bolt 29. These azimuth and elevation adjustments are made so that the aperture axis 24 of the offset antenna reflector 12 is aimed at the satellite in geosynchronous orbit (not shown). It should be noted that the angles for the azimuth and elevation are known from the position of the geosynchronous satellite and the latitude and longitude of the antenna's location. Of course, the orientation of the antenna may be "fine tuned" by actually measuring the received signal from the front end 15 of the satellite receiver.

In accordance with another important aspect of the invention, the pivot bolt 29 is torqued to a predetermined torque level using a torque wrench (not shown) so that the antenna will collapse from the predetermined geometric configuration established by the above mentioned alignment procedure to an alternate position that reduces axial wind loading by pivoting about the pivot bolt 29 when the axial wind force $F_A$ generates a torque exceeding the static friction of the pivot joint. The precise level of torque indicated on the torque wrench should be predetermined as a function of the desired threshold wind velocity, for example a threshold wind velocity of 45 mph. It should be noted, however, that the selection of the threshold wind velocity could be influenced by a variety of factors such as the size of the parabolic reflector 12, the size of the roof attachment pad 26, the actual construction of the roof 11, and the position of placement of the roof attachment pad on the roof 11.

Figure 3:
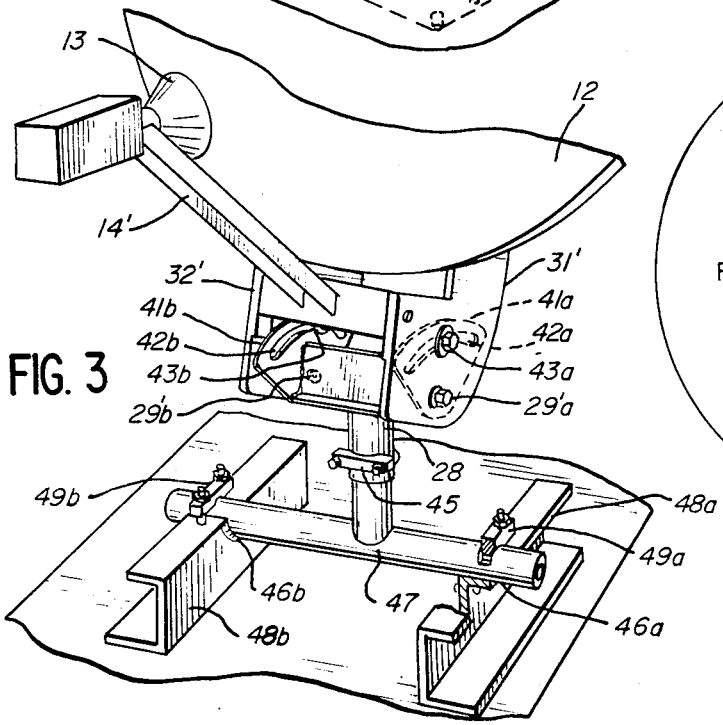
FIG. 3 is a perspective view of an alternative embodiment of the invention having an arcuate guide providing positive stops to prevent wind damage to the antenna, and also showing a variable pitch mounting pad.

For large antennas used in areas of high winds, a more rugged alternative embodiment shown in FIG. 3 may be used for limiting the range of movement of the antenna when the antenna pivots either forwardly or rearwardly to the collapsed configuration. An alternative cross-head 28' is used having side flanges **41*a*, 41*b* having arcuate slots 42*a*, 42*b*, respectively. Two pivot bolts 29'*a*, 29'*b* are provided as well as two slide bolts 43*a*, 43*b* for securing the modified mounting ribs 31', 32' to the alternate cross head 28'. The horizontal pivot bolts 29'*a*, 29'*b* and slide bolts 43*a*, 43*b* may be torqued with a torque wrench to a predetermined level so that the antenna collapses at a desired axial wind velocity. Moreover, the slide bolts 43*a*, 43*b* are disposed in the arcuate slots 42*a*, 42*b* so that the collapse of the antenna 10 in either the forward axial or reverse axial directions is limited by the ends of the arcuate slots. The alternative embodiment in FIG. 3 also shows certain minor variations in construction, including the use of a muffler-type clamp 45 to set the azimuthal adjustment and an alternative feed horn support beam 14' mounted to the ribs 31', 32' instead of the parabolic reflector 12**.

Also shown in FIG. 3 is a variable pitch mounting pad which has mounting pivots **46*a*, 46*b* connecting an inverted T post 47 to roof rails 48*a*, 48*b*. The roof rails are aligned up the slope of the roof so that the muffler-type clamps 49*a*, 49*b* may lock the pivots 46*a*, 46*b* to place the top of the inverted T post 47** in a vertical position.

According to additional important features of the invention, means for automatic rather than manual restoration of the antenna from the collapsed geometric configuration back to the first geometric configuration may be provided. As a further option, means may be provided for suddenly reducing the capacity of the antenna to react or absorb wind force when a predetermined wind velocity is exceeded.

Figure 4:
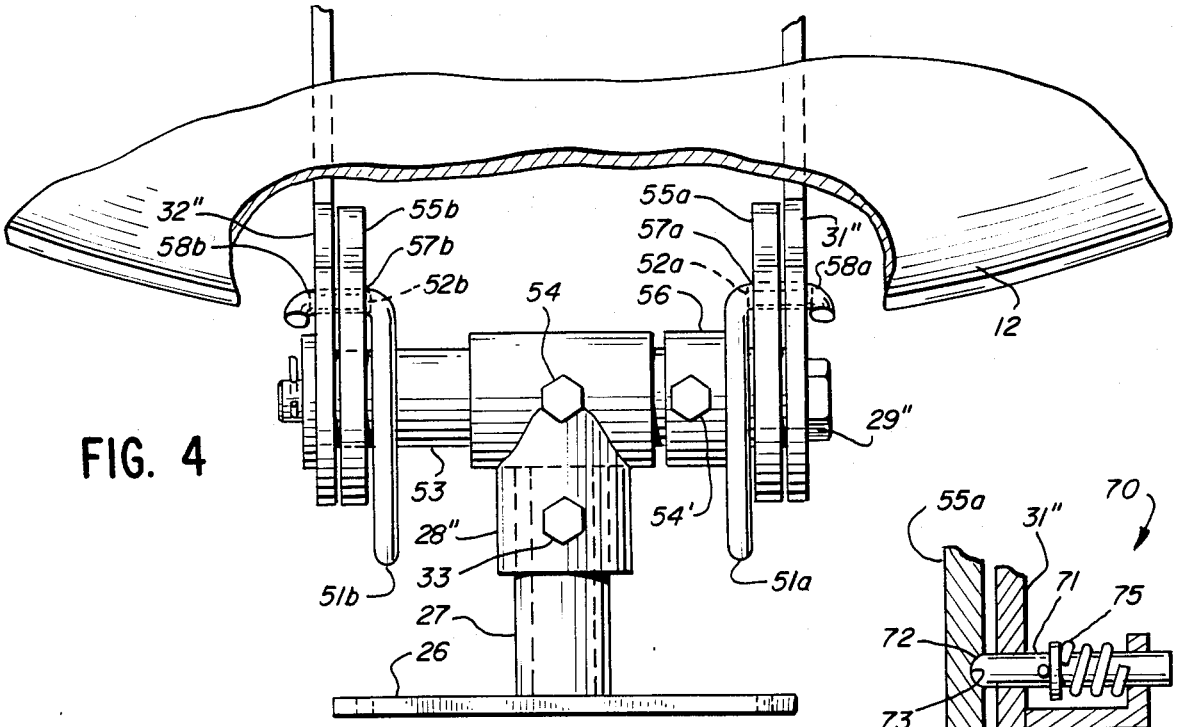
FIG. 4 is an elevation view of a third embodiment of the invention having a biased ring-type compression spring for automatically restoring the antenna to its normal operating configuration when the wind force lessens, and also having a shear pin for suddenly reducing the capacity of the antenna to react the wind force when the wind force exceeds a predetermined level.
Figure 5:
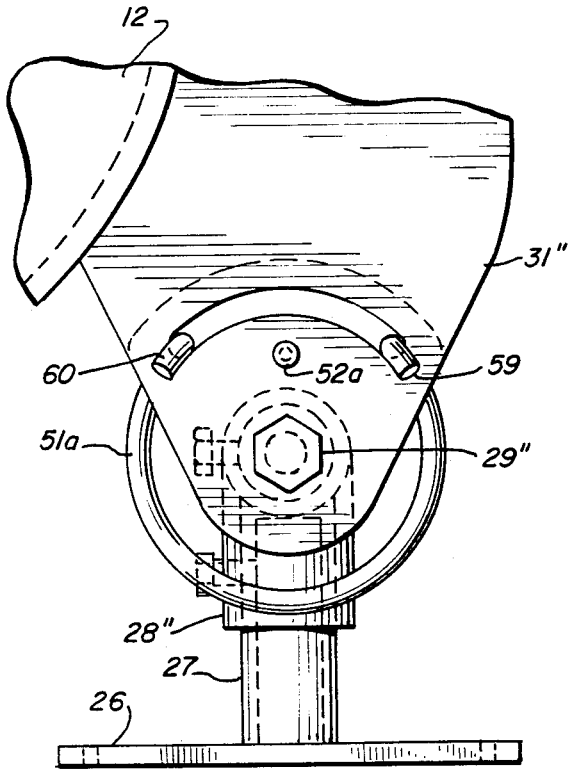
FIG. 5 is a side view of the embodiment shown in FIG. 4.
Figure 6:
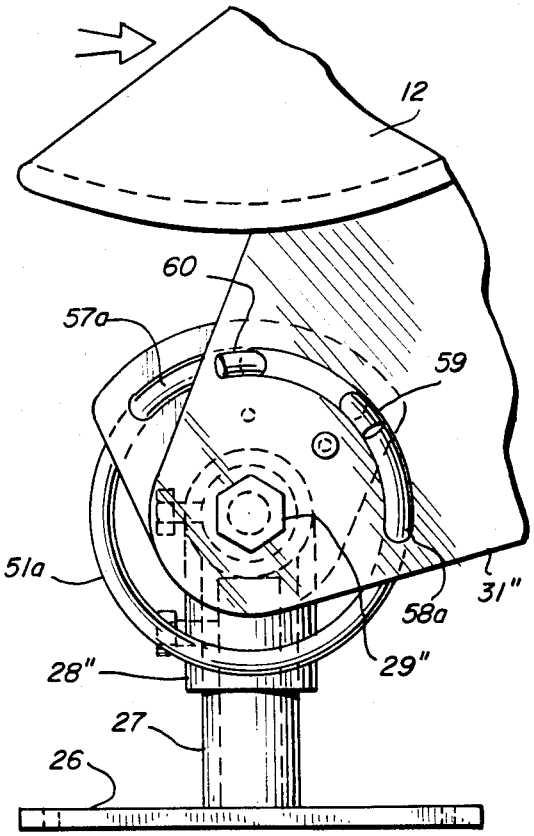
FIG. 6 is a side view corresponding to FIG. 5 illustrating the restoring action of the compression spring that is responsive to pivoting in both the forward axial and reverse axial directions.

As shown in FIGS. 4, 5, and 6, biased ring-type compression springs 51*a*, 51*b* are used to restore the antenna from the second geometric forward and reverse horizontal configurations when the axial velocity of the wind falls below a predetermined threshold velocity set by the bias of the compression springs. Moreover, shear pins 52*a*, 52*b* are also used so that the capacity of the antenna to react wind force is suddenly reduced when an axial wind force sufficient to shear the pins is encountered.

As shown in FIG. 4, the modified cross-head 28" receives a cylindrical cross-bar 53 which is rotatable with respect to the cross-head 28 about its axis, its axis being the horizontal pivot axis for the antenna. But the cross-bar 53 is permitted to rotate only during the initial elevation adjustment of the antenna, whereupon the cross-bar 53 is locked into place by advancement of an elevation locking screw 54 threaded into the modified cross-head 28". The ends of the cross-bar 53 are secured to two flanges 55*a* and 55*b*. While flange 55*b* is permanently welded to the cross-bar 53, the flange 55*a* has a collar 56 with a locking screw 54', the screw 54' being threaded to the collar 57 and advanced into the cross-bar 53 to secure the flange 55*a* to the cross-bar 53. It should be noted that the flange 55*a* could be welded directly to the cross-bar 53, but, as will be seen below, this will not provide for automatic alignment of the flanges 55*a* and 55*b*. As better shown in FIGS. 5 and 6, the flanges 55*a* and 55*b* are provided with arcuate slots 57*a*, 57*b* which index with similar arcuate slots 58*a*, 58*b* in the antenna ribs 31", 32". These pairs of slots 57*a*, 58*a* and 57*b*, 58*b* receive the ends of the ring-type compression springs 51*a*, 51*b* respectively. The compression springs are biased so that the pairs of slots, in the absence of axial wind forces above a predetermined level, are held in indexed relationship. Thus it should be noted that the flange collar 56 and adjustment screw 54' automatically assure that when the right-hand pair of arcuate slots 57*a*, 58*a* are indexed, then so will the left-hand pair of slots 57*b*, 58*b*, the proper alignment being established by spring force before the locking screw 54' is advanced.

As shown more clearly by comparing FIG. 5 to FIG. 6, the parabolic reflector 12 and mounting ribs 31", 32" are pivotally mounted to the cross bar 53 via a pivot bolt 29", defining a pivot axis, and the arcuate slots 57*a*, 57*b*, 58*a*, 58*b* subtend an angle of approximately 90° with respect to the pivot axis. Thus the arcuate slots 58*a*, 58*b* in the mounting ribs 31", 32" will in part align with the arcuate slots 57*a*, 57*b* in the flanges 56, 55 over approximately 180°, ranging from the parabolic reflector being in a forward horizontal position, to a vertical position wherein the slots are indexed, to a rearward horizontal position. Whenever the antenna configuration deviates from the vertical operating configuration, the compression springs tend to increase the arcuate area of overlap, which is the area of the arcuate slots between the tabs 59, 60 (shown in FIGS. 5 and 6) of the compression springs 51*a*, 51*b*. During assembly, when the antenna is initially in a vertical position, each compression spring is squeezed and its tabs are inserted into the indexed arcuate slots. When the tabs are released, the compression spring retains itself in the indexed arcuate slots and also seeks to maintain the arcuate slots in indexed relation. When a gust of wind exerts a force exceeding the predetermined initial spring bias, the parabolic reflector 12 pivots in the axial direction, for example the reverse axial direction shown in FIG. 6, whereupon the tabs of the ring-type compression spring are squeezed together. When the axial wind force subsides below the threshold velocity, the compression bias of the spring will force the antenna back to its vertical operating position as shown in FIG. 5.

The antenna mount shown in FIGS. 4, 5, and 6 is also provided with shear pins 52*a*, 52*b* which are means for suddenly reducing the capacity of the antenna to react wind force without collapse when a predetermined wind force, related to the shear strength and displacement of the pins from the pivot bolt 29", is exceeded. As shown in FIG. 5, the shear pins maintain the arcuate slots in precise indexed relation and thus enhance the rigidity of the antenna mount. When the predetermined wind force is exceeded, as shown in FIG. 6, the pins shear so that the response of the antenna to the axial wind force is then determined solely by the bias of the compression springs.

Figure 7:
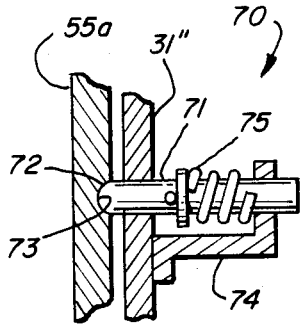
FIG. 7 is an elevation view of a spring loaded detent-type pin for preferably performing the quick-release function analogous to the function performed by a shear pin.

The shear pins 52*a*, 52*b* are not necessary elements to the restoring function of the compression springs 51*a*, 51*b*, since the springs have an initial bias and the antenna will not move until axial wind force $F_A$ exceeds the initial bias. But the shear pins prevent mechanical resonance of the inertial mass of the reflector 12 with the springs 51*a*, 51*b* that might occur, for example, in highly fluctuating wind conditions. Persons skilled in the art recognize that the shear action of the pins can be performed by spring-loaded detent pins, for example, the pin 71 shown in FIG. 7. A biased compression spring 75 holds the rounded end 73 of the pin 71 into engagement with a concave detent 72 in the flange 55*a*. The pin 71 itself is journalled to the antenna mounting rib 31" and a bracket 74 welded to the rib 31". Pivoting of the flange 55*a* is stopped by the engagement of the pin 71 with the detent 72, until an axial force $F_A$ generates sufficient shear force on the pin 71 to disengage the pin 71 from the detent 72. The required level of shear force is a known function of the detent 72 curvature and the bias of the compression spring 75. Unlike a shear pin which must be manually replaced after it is shorn, the detent mechanism is automatically reset when the antenna is restored to its normal, generally vertical operating position. It should also be noted that shear pins or detent pins could be used in alternative pivot embodiments such as that shown in FIG. 3, without requiring springs for automatic restoration of the antenna to the normal operating position.

What is claimed is:

1. A reflector-type microwave antenna assembly adaptable for rooftop mounting, said antenna assembly comprising, in combination, a parabolic reflector dish for receiving microwave signals and reflecting said signals into a waveguide, said reflector dish having a pair of generally parallel mounting ribs fastened to the backside thereof, and an antenna mount including a mounting pad, a generally vertical post attached to and extending above said mounting pad, and a cross-head rotatably mounted on said vertical post and disposed between said pair of mounting ribs, said cross-head receiving a generally horizontal pivot bolt securing the cross-head between said mounting ribs, said cross-head having azimuthal locking means for fixing the angular position of the cross-head on said vertical post, a pair of side flanges abutting respective ones of the mounting ribs, each of said side flanges having an arcuate slot generally centered about said pivot bolt, and means disposed within each of said arcuate slots for securing the mounting ribs to the respective side flanges when wind force tending to pivot said parabolic reflector about said pivot bolt is below a predetermined level, and for permitting limited pivoting of said parabolic reflector about said pivot bolt when said wind force exceeds said predetermined level, said limited pivoting being limited by the ends of said arcuate slots.

2. The reflector-type microwave antenna assembly as claimed in claim 1 wherein said means disposed within each of said arcuate slots comprise a pair of bolts, each of said bolts passing through a respective one of the arcuate slots, engaging the respective abutting mounting rib, and clamping the respective side flange to the respective abutting mounting rib.

3. The reflector-type microwave antenna assembly as claimed in claim 1 wherein said means disposed within each of said arcuate slots has means for defining a predetermined intermediate position within the range of said limited pivoting and means for restoring said parabolic reflector to said predetermined intermediate position when said wind force falls below said predetermined level.

4. The reflector-type microwave antenna assembly as claimed in claim 3 further comprising a spring-loaded detent precisely defining said intermediate position.

5. The reflector-type microwave antenna assembly as claimed in claim 1 wherein each of said mounting ribs has an arcuate slot registering with the arcuate slot in the respective abutting side flange, and said means disposed within each of said arcuate slots comprises a pair of ring-type compression springs, each of said springs having tabs extending through a respective one of the pairs of registering arcuate slots.

6. A reflector-type microwave antenna assembly adaptable for rooftop mounting, said antenna assembly comprising, in combination, a parabolic reflector dish for receiving microwave signals and reflecting said signals into a waveguide, said reflector dish having a pair of generally parallel mounting ribs fastened to the backside thereof, and an antenna mounted including a mounting pad, a generally vertical post attached to and extending above said mounting pad, and a cross-head rotatably mounted on said vertical post and disposed between said pair of mounting ribs, said cross-head receiving a generally horizontal pivot bolt securing the cross-head between said mounting ribs, said cross-head having azimuthal locking means for fixing the angular position of the cross-head on said vertical post, a pair of side flanges abutting respective ones of the mounting ribs, each of said mounting ribs having an arcuate slot generally centered about said pivot bolt, and means disposed within each of said arcuate slots for securing the mounting ribs to the respective side flanges when wind force tending to pivot said parabolic reflector about said pivot bolt is below a predetermined level, and for permitting limited pivoting of said parabolic reflector about said pivot bolt when said wind force exceeds said predetermined level, said limited pivoting being limited by the ends of said arcuate slots.

7. The reflector-type microwave antenna assembly as claimed in claim 6 wherein said means disposed within each of said arcuate slots has means for defining a predetermined intermediate position within the range of said limited pivoting and means for restoring said parabolic reflector to said predetermined intermediate position when said wind force falls below said predetermined level.

8. The reflector-type microwave antenna assembly as claimed in claim 7 further comprising a spring-loaded detent precisely defining said intermediate position.

9. The reflector-type microwave antenna assembly as claimed in claim 6 wherein each of said side flanges has an arcuate slot registering with the arcuate slot in the respective abutting mounting ribs, and said means disposed within each of said arcuate slots comprising a pair of ring-type compression springs, each of said springs having tabs extending through a respective one of the pairs of registering arcuate slots.

* * * * *